US006227834B1

(12) United States Patent
Andersen

(10) Patent No.: US 6,227,834 B1
(45) Date of Patent: May 8, 2001

(54) SCREW COMPRESSOR WITH ADJUSTMENT SLIDE MEANS

(75) Inventor: Lars Skovlund Andersen, Mårslet (DK)

(73) Assignee: Sabroe Refrigeration A/S, Højbjerg (DK)

( * ) Notice: Subject to any disclaimer, the term of this patent is extended or adjusted under 35 U.S.C. 154(b) by 0 days.

(21) Appl. No.: 09/284,454

(22) PCT Filed: Oct. 15, 1997

(86) PCT No.: PCT/DK97/00453

§ 371 Date: Apr. 15, 1999

§ 102(e) Date: Apr. 15, 1999

(87) PCT Pub. No.: WO98/17915

PCT Pub. Date: Apr. 30, 1998

(30) Foreign Application Priority Data

Oct. 15, 1996 (DK) ..... 1140/96

(51) Int. Cl.[7] ..... F04C 18/16; F04C 29/08
(52) U.S. Cl. ..... 418/201.2
(58) Field of Search ..... 418/201.2

(56) References Cited

U.S. PATENT DOCUMENTS 4,281,975 * 8/1981 Blackwell ..... 418/201.2

FOREIGN PATENT DOCUMENTS 2 122 687 1/1984 (GB) .
1092300 * 5/1984 (RU) ..... 418/201.2
430 710 12/1983 (SE) .
464 532 5/1991 (SE) .

* cited by examiner

*Primary Examiner*—John J. Vrablik
(74) *Attorney, Agent, or Firm*—Nixon Peabody LLP; David S. Safran

(57) ABSTRACT

A screw compressor having an adjustment slide equipment for adjusting discharge pressure and capacity, respectively, is designed in an advantageous manner in that there is used a "large slide" (24), which is longer than the compressor screws (4, 6) and thereby, via a pointed end portion (14) and in connection with an axial displacement, is operable to effect pressure adjustment at the discharge port (10) without affecting the conditions at the intake end; at the latter, a capacity adjustment can be effected by means of an auxiliary slide (26) which, seen in cross section, forms part of the large slide, and which is separately axially displaceable in a groove (30) therein, such that it is possible to open this groove to a variable degree towards the meeting area of the screw rotors. This basic design in connection with an unusually large diameter of the main slide (24) provides for several advantageous possibilities discussed in greater detail.

11 Claims, 3 Drawing Sheets

SCREW COMPRESSOR WITH ADJUSTMENT SLIDE MEANS

The present invention relates to a screw compressor having slide means for adjustment of capacity and compression, respectively. The capacity is adjusted at the intake end in that the slide means are caused to change the axial location of the area, from which the two co-operating screw rotors "cut off" the intake gas, such that the cut off gas can only be housed inside the remaining axial working length of the two rotors, while the degree of compression is determined by way of such a slide adjustment which affects the effective degree of opening of the discharge port of the compressor. The gas discharge takes place both radially and to a smaller degree axially, and it is thus possible to adjust it by a more or less pronounced projection of a wedge body into a fixed discharge port in the compressor housing at the discharge end of the screw rotors.

In practice, the said slide means are arranged at the "meeting side" of the counter rotating screw rotors, with the discharge port located at the end of this area. The slide means should fit very closely to the surface configuration of the rotors, though out of touch therewith, whereby the slides comprise an elongated sealing part with a roof ridge like cross section and an associated guide body part mounted in a guiding groove in the wall of the compressor housing. In practice it is preferred to make use of a circular cylindrical shape of the said body part, even though this may seem unsuitable in view of the fact that the "roof ridge part" should be stabilised in the lateral direction in such a manner that with its extremely close proximity to the rotor surfaces it should be effectively prevented form being laterally displaced or rotated into touch with these surfaces. A cylindrical body part is not effective for this purpose, but for economical reasons it is necessary to use reasonably simple working techniques, also for the shaping of the guiding groove of the compressor housing. It should then in some other way be ensured that the slides as respective wholes cannot rotate in the part cylindrical guiding groove.

The are known more different solutions of this problem, e.g. the use of a cut axial guiding track in the slides diametrically opposite to the active sealing part, whereby a fixed pin or roller of the compressor housing may intrude into this track and thus prevent a rotation of the slide. According to another known solution the 'roof ridge part' is anchored in the transverse direction in being in a direct, sliding guiding engagement with the side walls of the said discharge port and intake port, respectively. However, these guiding principles suffer from certain drawbacks, which should be seen in connection with the remainder of the slide construction, confer remarks below.

If it was or is desirable to be able to effect an adjustment solely of the degree of compression, then this is achievable by means of a single slide, which can be axially displaced such that its pointed front end can fill out the discharge port to a higher or lesser degree, while at the intake port it will seal against the rotors irrespective of its axial position. The problem underlying the invention is that a natural desire of an adjustability even of the capacity of the screw compressor will require the effective length of the slide to be variable, such that at the intake area the slide can provide for a more or less pronounced rotor sealing or, respectively, a cancellation of such a sealing along a certain axial length, whereby the rotors cannot build up neither a suction nor a compression effect along this length.

Traditionally, this has resulted in the slide means being constituted by two coaxially arranged slides which, by suitable moving means, are axially displaceable in such a manner that the foremost slide is controllable to a graduated projection into the discharge port, while a rear slide is separately axially displaceable such that at the intake end it may define a more or less wide gap between the two slide elements for adjusting the intake capacity. The two slide elements should be axially coupled together in a sort of telescopic system, and this is the reason for the above indicated problems to exist:

In response to various external forces, e.g. originating already from thermal influences, the two slide elements may behave in an almost inpredictable manner, whereby the said telescopic connection may be subjected to uncontrolled and highly damaging flexing in view of the extreme tolerance requirements.

On this background and in connection with the invention it has been realised that it is indeed possible to provide a slide, which can act as a unitary, stiff member, viz. in the from of a large-slide which, itself, has a length sufficiently for it to carry out a full adjustment displacement at the discharge port, without thereby being displaced so as to expose the rotors at their intake ends, said large slide over a length at the intake end being shaped with a guiding groove in the very 'roof ridge area' of the slide, in which groove there is slidably received a mini slide, which has a portion projecting from the groove so as to complete the large slide in forming the said roof ridge portion, said mini slide being axially guidable between an advanced position, in which it fills out the guiding groove, and a retracted position, in which the groove is open towards the rotors at least along a substantial partial length of the groove. In this manner it will be possible to still effect a capacity adjustment, even though the width of the minislide is noticeably smaller than the total width of the roof ridge area of the large slide; even a relatively narrow shorting between the rotors will give rise to such a drop of compression that this can be used directly for a capacity adjustment.

The invention presents more different constructional and functional aspects. The reference to a large slide should not only apply to the slide length, which, in total, will be greater than the length of the rotors, but also to the cross sectional size of the slide, which should preferably be relatively large, viz. of the same magnitude as that of the rotors, while conventionally the slide size has been considerable smaller. According to the invention it is even a preferred feature that the guiding groove for the large slide is made with exactly the same diameter as the rotor bores of the compressor housing, as this will favour a rational working of the precast compressor housing.

However, irrespectively of the more detailed design of the large slide there are circumstances worth being mentioned on the background already discussed:

1) The large slide will have the character of a very stiff beam, this being unaffected by the presence of the minislide. The large slide is influenced crosswise by the compression pressure, with a maximum adjacent the discharge port. Inasfar as the pressure is countered at the area between the opposite ends of the slide, the latter as a whole will be forced against its guiding base in a well defined manner, such that there will be no remaining uncertainty with respect to force phenomena as in the known telescopic connections.

2) Due to the fact that the 'roof ridge faces' of the large slide will engage with the rotors over an increased peripheral portion thereof, it is possible to design the discharge port with generally increased dimensions, this being highly advantageous in particular in connection with gasses of a low specific volume and at high suction pressures. It has previously been theoretically realised that the port areas used so far have been smaller than an optimal size, but it has been necessary to choose a compromise between ideal conditions at the intake port and the discharge port, respectively; this necessity, however, is eliminated by the present invention.

3) At the intake end it is correspondingly ideal that the large slide permanently forms a prolongation of the walls of the fixed rotor bores, only leaving space for the relatively narrow minislide adjacent to the very roof ridge area. In traditional systems with double slides, an opening of an axial gap between the slides implies a strong shorting between the rotors, and it is quite customary that a capacity adjustment over an almost full range between 100% and 10% is effected by a relative slide displacement of only some ⅛ of the length of the rotors. With the use of the minislide for this purpose the adjustment length can be increased noticeably, e.g. up towards the half of the rotor length, whereby it is possible to effect a fine adjustment, if so desired, much more effectively without in any way compromising the improved conditions at the discharge port.

Thus, the use of the large slide/minislide concept of the invention is very advantageous, but there are some associated problems which, in principle, could be disregarded in the present connection, but which have also been settled by the development of the invention for practical use. A problem is that due to its large size the slide will be influenced by very high forces. Radial forces from the compressed gas act on the relatively large roof ridge faces, whereby the slide is forced very strongly against its opposite guiding face, but this is compensated for by virtue of that guiding face being correspondingly relatively large. The entire, large front end area of the slide will be located in the discharge zone of the compressed gas, whereby the slide is influenced by high retraction forces. Even with the use of a "big beam" slide, there may still occur arbitrary radial forces directed towards the rotor surfaces, and when the relevant spacing should be a matter of micrometers it will be important to provide a suitable support for the slide not only away from, but also towards the rotors. Moreover, the axial pressure should be countered or compensated for by correspondingly high counter forces in the system used for controlling the adjustment movement of the slide.

These potential problems connected with the invention have been overcome partly by providing additional radial support means and partly by an axial force balancing of the large slide by using the pressure of the discharge gas. These special concepts, which could even be advantageously applicable in conventional systems, will be explained below in more detail, in connection with a description of the invention with reference to the drawings, in which.

Figure 1:
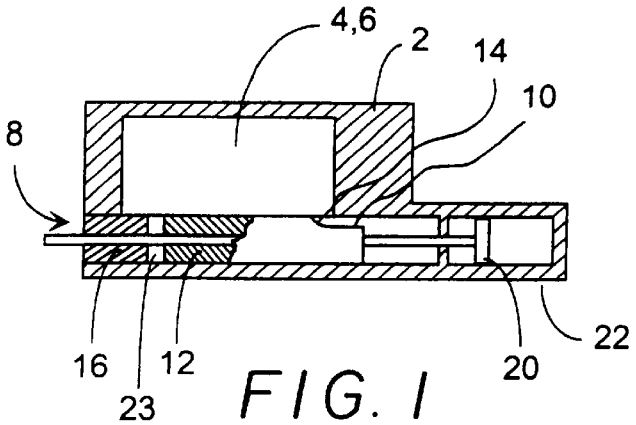
FIG. 1 is a longitudinal sectional view of a conventional screw compressor.
Figure 2:
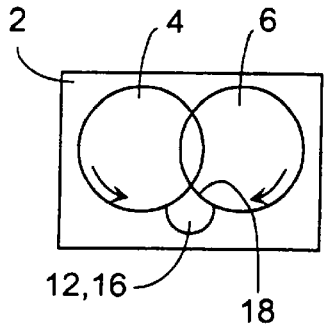
FIG. 2 is a cross sectional view thereof.

In a conventional manner, the screw compressor shown in FIGS. 1 and 2 has a compressor housing 2 with two screw rotors 4 and 6, the screw threads of which are sealingly interengaging and operate in the manner that they currently form thread chambers which are at first in open connection with an intake or suction conduit 8, whereafter they are closed and then narrowed for compression of the intake gas towards a more or less restricted discharge port 10 which, in a manner not shown, is connected to the pressure system to be served by the compressor, e.g. a refrigeration system.

In alignment with the intake and discharge ports 8 and 10 and next to the meeting area of the rotors there is arranged a slide system comprising a foremost slide 12 with a front depression 14 and a rear slide 16. Both of these slides have the cross section shown in FIG. 2, and it will be noted that the slides seal operatively against the rotors by means of 'roof ridge faces' 18 meeting in a sharp ridge. In general, these faces are just a completion of the rotor bores of the compressor housing for complete covering of the rotor peripheries, but because they are axially displaceable these slides can be used for adjustment purposes. Thus, by a displacement of the slide 12 effected by means of a piston 20 in a protruding control cylinder 22 the front depression 14 may be projected more or less widely into the discharge port 10, whereby the degree of compression can be adjusted. The slide 16 can be correspondingly displaced by means of non-illustrated moving means, whereby a more or less wide gap 23 can be provided between the slides 12 and 16, invoking a more or less pronounced degree of operative, direct shorting between the rotors 4 and 6, whereby it is possible to adjust the intake capacity and therewith the power consumption of the compressor.

As already mentioned, special impact problems may occur in this known system, which, however, will not be analysed in more detail at this place.

Figure 3:
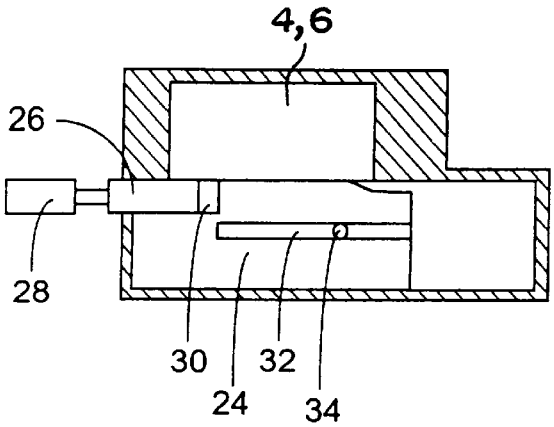
FIGS. 3 and 4 are corresponding view of a screw compressor according to the invention.
Figure 4:
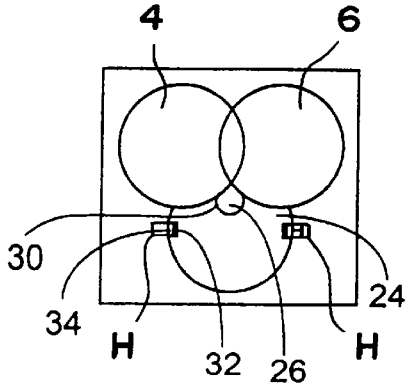

By a consideration of FIGS. 3 and 4, which are corresponding views of a compressor according to the invention, it will be easily noticed partly that the slide system appears with a considerably increased diameter and partly that in the longitudinal direction there are not two mutually separable slides 12 and 16, but only a single "big slide" 24 with a length longer than the rotors 4 and 6. As already mentioned, this large slide exhibits different advantages with respect to mechanical stability and the enabling of an adjustment in a desirably large discharge port.

However, the large slide 24 is provided with an insert slide in the form of a narrow, rear "minislide" 26, which is connected to an external, fixed moving mechanism such as a cylinder 28 and is received in a groove 30 in the slide 24. As apparent in particular from FIG. 4, this minislide only covers a narrow area adjacent the said 'roof ridge' of the large slide, whereby, as mentioned, it is suited to effect a highly differentiated capacity adjustment. In practice, however, this is not of any superior importance, while it rather is important that it is possible, at all, to enable a capacity adjustment, optionally in large steps, without this being associated with a generally narrow slide width, which, at the discharge port, would present problems with respect to the desirable size of that port.

In the system according to the invention the large slide 24 is so large that it is influenced by noticeably increased pressure forces from the compressed gas, both radially outwardly against the guiding support and axially rearwardly from the rearwardly acting compression at the front end of the slide. On this background, the invention provides for certain measures that may be of more extensive significance:

a) Taking Up of Radial Pressure

In order to prevent the slide from being pressed upwardly into touch with the rotors it has been found possible to arrange for support, viz. at the opposite sides of the slide, where the slide is provided with longitudinal grooves 32 cooperating with respective cam rollers 34, which are mounted projecting from the wall of the guide bore for the slide at an area just behind the discharge port 10, i.e. in the area where the slide is exposed to maximum radial pressure. Preferably, the cam rollers are supported by eccentrically arranged carriers, such that they can be adjusted very accurately in the height direction, whereby they will be adjustable to form effective stop means for a raising of the slide such that the roof ridge faces 18 may be stabilised in a position only few micrometers from the rotor surfaces. The height adjusting mechanism is merely schematically depicted at H in FIG. 4.

By this accurate support of the slide it is additionally achieved that the slide will be totally secured against rotational movements, such that it will need no further support in the peripheral direction. So far it has been preferred for a lateral support that the roof ridge faces 18 be in a direct sliding engagement with the corresponding guiding faces of the discharge port 10; in that case, however, these guiding faces should be worked with an accuracy in the micrometer range, which will now no longer be necessary. This is a marked advantage of the use of the position adjustable cam rollers 34.

b) Taking Up of Axial Pressure

In the prior art it has been relatively easy to stabilise the slide system against the marked pressure difference between the front and rear end of the system, viz. by means of the piston/cylinder system 20, 22, FIG. 1. Such a system, of course, may be upgraded to suit the conditions in connection with the invention, but in the latter connection it has, however, been realised that the problem can be solved in a basically simplified way, viz. in designing the slide itself as or with a cylinder/piston system which fills out approximately the half of the cross sectional area of the slide and is supplied with the discharge pressure at its rear end and with the intake pressure or an auxiliary pressure at its front end. In this manner the slide may be axially balanced, such that for an operative displacement of the slide it is sufficient to apply small added forces, no matter how big the occurring pressure difference is.

This cylinder/piston system may be arranged internally in the slide itself, while an associated control system can be arranged with short axial spacing from the slide or the slide housing, such that the said conventional piston/cylinder system 20, 22 can be entirely avoided. It is important that the total building length of the compressor may hereby be reduced by avoiding the external control cylinder for the slide adjustment.

Figure 5:
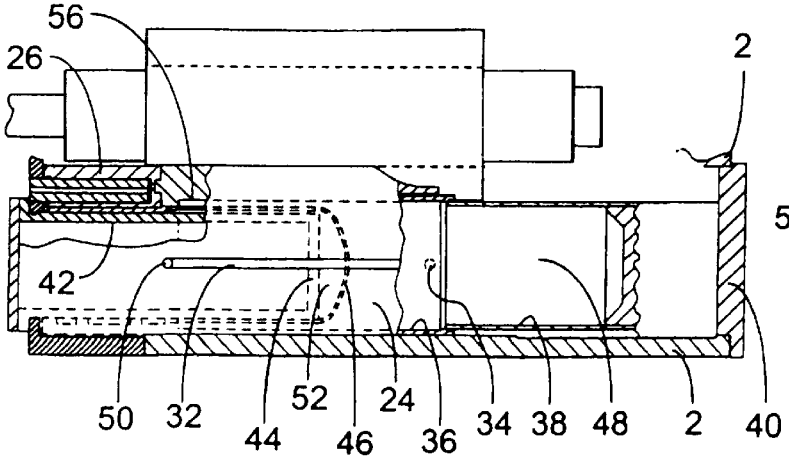
FIGS. 5 and 6 are further corresponding view showing in greater detail a preferred embodiment of the invention.
Figure 6:
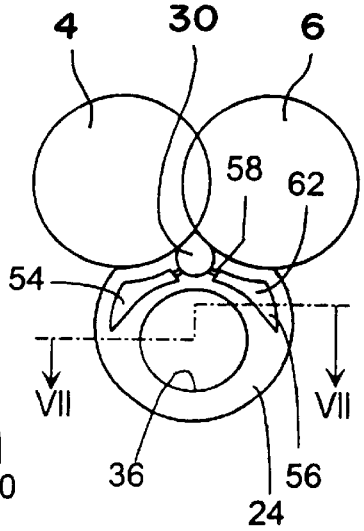
Figure 7:
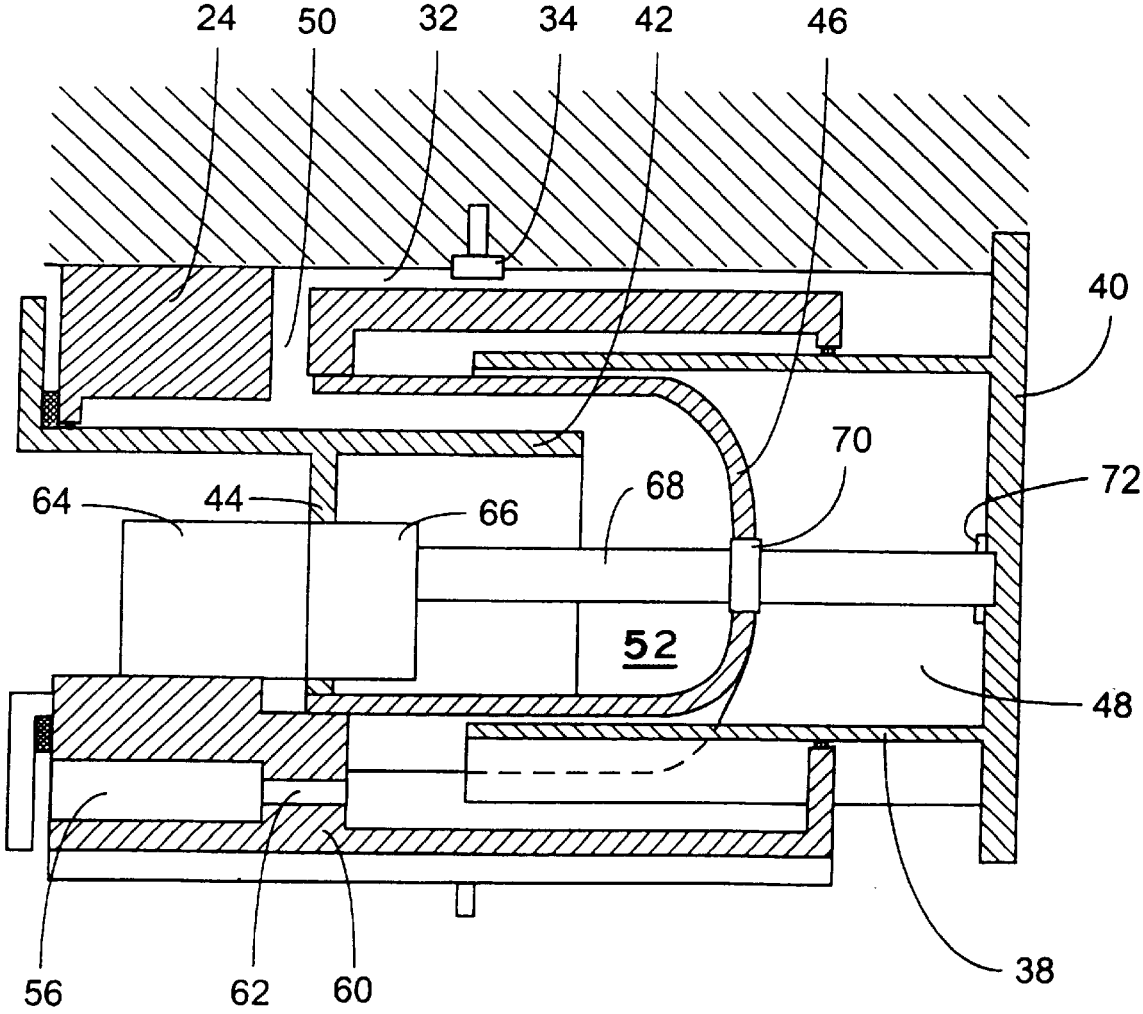
FIG. 7 is a longitudinal section seen from above along the line VII—VII of FIG. 6.

FIGS. 5–7 show an embodiment which is preferred in practice and which makes use of a gear motor with an associated screw spindle for controlling the slide adjustment. The general layout with the slide 24 in FIG. 5 can be recognised from FIG. 3, including the cam roller groove 32. The slide is provided with an eccentrically located cylinder bore 36 which is sealingly inserted to slide over the exterior of a foremost, fixed cylinder part 38 projecting rearwardly from a flange 40 secured to the compressor housing. At the rear, the bore 36 is slidably sealed against a fixed, forwardly projecting cylinder 42 having near its middle a fixed cross wall 44. At its middle area, the slide 24 is provided with a cup cylinder 46 which, as shown in FIG. 5, can project over the cylinder 42, while for a movement of the slide towards the right it can slide forwardly inside the fixed cylinder part 38, without sealing thereagainst, as shown in FIG. 7. The cylinder space between the cup cylinder 46 and the front flange 40 is denoted 48.

At the rearmost, closed end of the cam roller groove 32 there is provided a radial hole 50, which as shown in FIG. 7 is located at the rear end of the cup cylinder 46 and forms a connection to the open cylindrical space between this cylinder and the fixed cylinder 42. Thus, the pressure from the discharge end of the compressor will be conveyed through the groove 32 and the hole 50 to the space, designated 52, between the front end of the cup cylinder 46 and the fixed middle wall 44, i.e. this pressure will seek to force the slide towards the right, while the same pressure at the front end of the slide seeks to force the slide to the left.

Correspondingly, it is desirable to connect the space 48 to the suction pressure side of the compressor, such that the pressure in this space or chamber will be independent of the chamber being expanded and narrowed by the movements of the slide. Such a connection may be arranged externally, but it is preferred to arrange it internally in the following manner:

As shown in FIG. 6, the slide 24 is provided with a pair of channels 54 and 46 which extend forwardly from the rear end of the slide, with a length almost the same as that of the guiding groove 30 for the minislide, and these channels are in flow connection with the groove 30 through a row of transverse holes 58. The channels 54 and 56 extend to the area adjacent the said radial hole 50, where they end at a block portion 60, shown at the bottom of FIG. 7, in front of which the internal diameter of the outer cylindrical body of the slide widens for co-operation with the fixed front cylinder 38. According to FIGS. 6 and 7, a pair of through bores 62 are provided in the block portion 60 at the end of the channel 56, whereby the channel 56 will be in open flow connection with the said widened space, which, via the gap between the cylindrical parts 38 and 46, will be correspondingly flow connected with the space 48. Thus, the latter space will be in permanent connection with the suction side of the compressor.

As shown in FIG. 7, the fixed middle wall 44 carries an electric or hydraulic motor 64 which, via a tight transmission such as a magnet coupling, drives a gear 66 rotating a screw spindle 68. This spindle projects forwardly through a nut bushing 70 in the closed end of the cup cylinder 46 and further to a bearing 72 in the fixed front flange 40.

Inasfar as the pressure differences acting on the large slide will be practically balanced out not matter the operational conditions, the slide position can be adjusted with the use of a relatively small motor 64, and the nut bushing 70 will be effectively self locking on the spindle 68 against carrying out arbitrary movements therealong, i.e. the slide will be held in a stable manner in all positions.

It would be possible to arrange for the minislide 26 to be moved by moving means mounted on the large slide 24 itself, but as indicated already in FIG. 3 it is preferred that it is moved by external, rigidly mounted moving means such as the cylinder 28. These means will then have to be operated separately if, in connection with a slide adjustment for changing the degree of compression, it is desirable to maintain a given capacity adjustment. If it is desired to maintain full capacity, this will be easily achievable by maintaining a sufficient pressure on the piston in the cylinder 28, as the minislide 26 will then be forced forwardly to close the opening 23, irrespective of the adjustment movements of the large slide within the normal adjustment range thereof.

Figure 8:
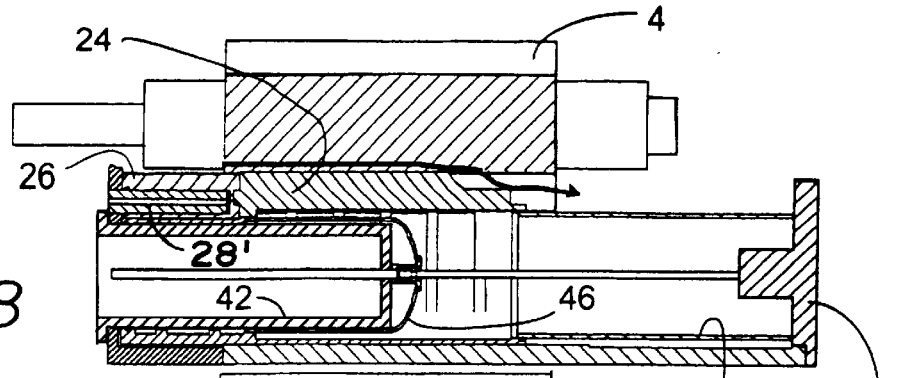
FIGS. 8–12 are longitudinal sectional view of the compressor shown with its parts in different positions.

Hereafter, the FIGS. 8–12 showing different positions of the large slide and the minislide, respectively, should be briefly described:

In FIG. 8 the large slide 24, hereinafter denoted the slide only, is shown fully retracted, i.e. with maximum opening of the discharge port 10 and thus with a minimum of compression. The minislide 26 assumes a fully closed position, i.e.

fully projected for closing of the groove 30, whereby the compressor will operate at full capacity. It will also be noted that the minislide is mounted as a piston bushing on a projecting guiding tube 28' for supplying control medium, whereby no extra space is required in the longitudinal direction.

Figure 9:
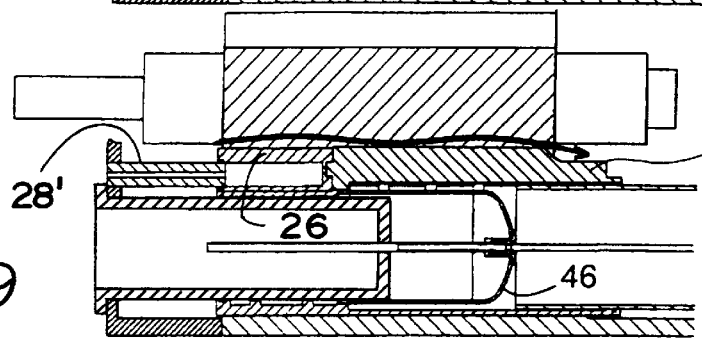

In FIG. 9 the slide 24 is moved forwardly so as to widely close the discharge port 10, i.e. for achieving maximum compression, and the minislide 26 is correspondingly projected, such that full intake capacity is still maintained.

Figure 10:
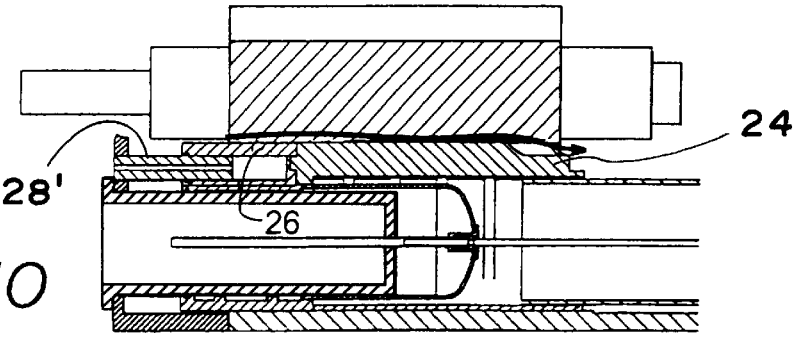

In FIG. 10 the slide 24 assumes a middle position, in which then also the compression adopts an intermediate degree. The minislide 26 is still in its closed positions, though now in an intermediate position on its associated driving cylinder 28', such that there is still operated with 100% intake capacity.

Figure 11:
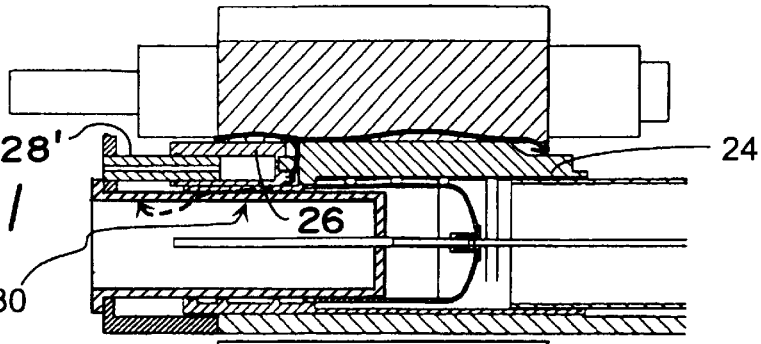

In FIG. 11 the slide 24 assumes the same middle position, but with the minislide 26 somewhat retracted, such that at the front end of the groove 30 there is formed a shorting space, in which no effective intake suction can be effected, and from which already sucked-in and partially compressed gas may escape to the intake end of the compressor as indicated by a dotted return arrow. Use is hereby made of the hole connections 58 (FIG. 6) between the guiding groove 30 (FIG. 4) of the minislide and the axial return channels 54 and 56 in the slide.

Figure 12:
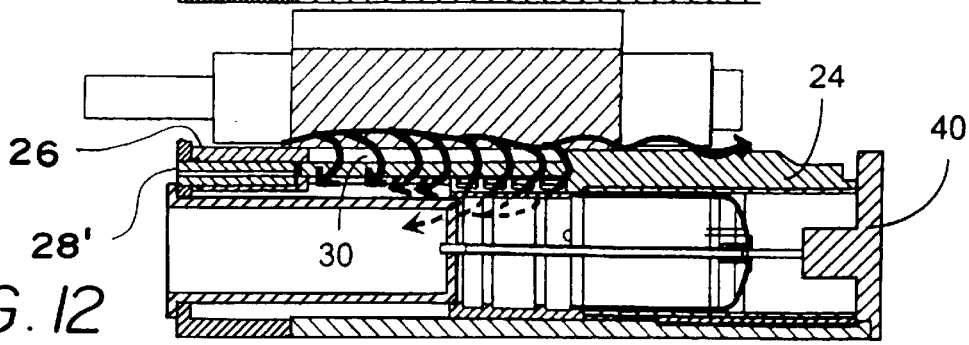

In FIG. 12 the slide 24 is shown extremely projected, for maximum closure of the discharge port 10, while the minislide 26 is preferably entirely retracted so as to condition a minimum of capacity, i.e. in general with minimum load of the compressor. The slide 24 and its minislide groove 30 will here be projected to a position widely in front of the front end of the minislide 26, such that initially sucked-in gas, if any, can readily escape for returning to the suction side as indicated by arrows. Thus, the entire stretch forwardly to the rear end of the slide 24 will be an inoperative bypass stretch, in which the return holes 58 and channels 54, 56 will be substantially inoperative.

It should be mentioned that in connection with the invention it has been found desirable and realizable that the minislide 26 is not adjusted gradually between its extreme positions, but is controlled only for full opening or closing of the groove 30, this highly facilitating the control of this slide. Certain transient problems may occur, but these will be widely compensated for by virtue of the slide 24 being able to rapidly adjust itself in a stable manner for achieving a suitable compression effect.

What is claimed is:

1. A screw compressor comprising:

a compressor housing having an intake end and a discharge port at opposite ends of the compressor housing;

two parallel and interengaging screw rotors arranged in rotor bores within said housing extending axially between the intake end and the discharge port;

and a system of slides mounted in a guide passage for displacement parallel to an axial direction between the intake end and the discharge port and generally sealing against a peripheral meeting area between the screw rotors;

wherein the slide system comprises two radially interengaging and axially mutually slidable slides, one partially encircling the other;

wherein a first of said slides is a discharge compression adjusting main slide that has a wedge formed front end portion which, by a controlled axial displacement, is positioned to block the discharge port to a higher or lesser degree for adjusting a resulting degree of compression produced by said rotors, said adjusting main slide being longer than the rotors;

wherein a second of said slides is a narrow, intake capacity adjusting auxiliary slide is mounted in a guiding groove located along a rearmost stretch of the meeting area between the screw rotors in an area at an intake end of the rotors in a manner enabling axial adjustment of the auxiliary slide separately from said main slide and enabling adjustment of compressor intake capacity;

wherein separate control means is connected to the auxiliary slide for axially displacing said auxiliary slide in said guiding groove between a projected position, in which the auxiliary slide fills out the guiding groove, and at least one retracted position, in which the guiding groove is open towards said meeting area over at least part of the length of the guiding groove; and wherein the main slide generally fills out the entire cross section of said guide passage except for a portion, located next to said meeting area at the intake end of said main slide, which is completed by said auxiliary slide.

2. A screw compressor according to claim 1, wherein side holes are provided in the groove wall through which the guiding groove is in flow connection with axial channels debouching freely in the intake chamber of the compressor.

3. A screw compressor according to claim 1, wherein the main slide has a diameter of the same magnitude as the diameter of the screw rotors, and that the main slide seals against the rotors along part cylindrical segments which are wider than corresponding sealing segments of the auxiliary slide.

4. A screw compressor according to claim 3, wherein the guide passage of the compressor housing accommodating the main slide has the same diameter as the rotor bores of the housing.

5. A screw compressor according to claim 1, wherein height adjustable side rollers are provided in engagement with longitudinal guiding grooves in the main slide for stabilizing the main slide in a cross plane.

6. A screw compressor according to claim 5, characterized in that the side rollers, which prevent the slide from getting in touch with the rotor surfaces, are provided adjacent to the discharge ends of the rotors.

7. A screw compressor according to claim 1, in which the front end of the main slide is subjected to the discharge pressure of the compressor, while its rear end is subjected to the suction pressure thereof, wherein the main slide itself has a a cylinder/piston system filling out approximately half of the cross sectional area of the main slide and is subjected to the discharge pressure at its rear end and to the intake pressure or an auxiliary pressure at its front end.

8. A screw compressor according to claim 7, wherein the discharge pressure is applied internally of the main slide through a side groove in the main slide and a cross hole in the slide wall, said groove being open towards the discharge end.

9. A screw compressor according to claim 7, wherein suction pressure is applied internally of the main slide through a channel directly through the rear end portion of the slide.

10. A screw compressor according to claim 7, wherein a moving system is provided within the main slide, said moving system controlling movement of the main slide in its longitudinal direction.

11. A screw compressor according to claim 10, wherein said moving system comprises a gear motor co-operating with a screw spindle which, when rotated, operates to drive the slide in the longitudinal direction.

* * * * *